US006001150A

United States Patent [19]

McCall et al.

[11] Patent Number: 6,001,150

[45] Date of Patent: Dec. 14, 1999

[54] BORIC ACID-CONTAINING LUBRICANTS FOR POWERED METALS, AND POWERED METAL COMPOSITIONS CONTAINING SAID LUBRICANTS

[75] Inventors: James M. McCall, Montreal; John Blachford, Westmount; Margaret Cole, St. Hubert, all of Canada

[73] Assignee: H.L. Blachford Ltd./LTEE, Canada

[21] Appl. No.: 08/937,398

[22] Filed: Sep. 25, 1997

[51] Int. Cl.[6] ..... B22F 3/12

[52] U.S. Cl. ..... 75/255; 419/36; 419/38; 419/54

[58] Field of Search ..... 419/36, 38, 54; 75/255

[56] References Cited

U.S. PATENT DOCUMENTS 5,368,630 11/1994 Luk .
5,429,792 7/1995 Abridgement .
5,527,624 6/1996 Higgins et al. ..... 428/523
5,819,154 10/1998 Hu et al. ..... 419/11

OTHER PUBLICATIONS

Enhanced Green Strength Material System for Ferrous and Stainless P/M Processing, Sidney H. Luk et al, Presented at PM$^2$TEC '96 World Congress, Jun. 16–21, 1996, Washington, D.C.

*Primary Examiner*—Daniel J. Jenkins
*Attorney, Agent, or Firm*—Bachman & LaPointe, P.C.

[57] ABSTRACT

Boric acid-containing lubricants are disclosed which consist essentially of boric acid and at least one other powder metallurgy lubricant and provide a synergistic free-flowing composition. There are also provided novel compositions of matter for forming sintered metal components comprising a mixture of sinterable, powdered metal and the said lubricants.

22 Claims, No Drawings

BORIC ACID-CONTAINING LUBRICANTS FOR POWERED METALS, AND POWERED METAL COMPOSITIONS CONTAINING SAID LUBRICANTS

BACKGROUND OF THE INVENTION (a) Field of the Invention

This invention relates to lubricants for powder metallurgy and to the manufacture and use of lubricants.

More particularly the lubricant comprises an admixture of lubricants comprising boric acid as one of the components.

(b) Description of Prior Art

Powdered metals, for example, powdered iron, are used to make small, fairly intricate parts, for example, gears. The fabrication of such metallic parts by powdered metal technology involves the following steps:

(a) the powdered metal is blended with a lubricant and other additives to form a mixture, (b) the mixture is poured into a mold, (c) the mixture is compacted in the mold to form a part using high pressure, usually of the order of 30 tons per square inch, (d) after compaction the part is ejected from the mold, (e) the ejected part is subjected to a high temperature to decompose and remove the lubricant, (f) the part is heated to a higher temperature to cause all of the particles of metal in the part to sinter together and (g) the part is cooled, after which it is ready for use.

Commonly used lubricants include zinc stearate, lithium stearate, lithium 12-hydroxystearate, ethylenebisstearamide, and stearic acid.

The lubricant is added to the powdered metal for several reasons; in particular the lubricant increases the bulk density of the uncompacted powdered metal. This means that the molds can be shallower, for a given thickness of the final part. The bulk density is generally referred to as the apparent density and is determined according to the Metal Powder Industries Federation Standard No. 04, Determination of Apparent Density of Free-Flowing Metal Powders Using the Hall Apparatus.

Some lubricants increase the rate of addition of the metal powder to the mold, when admixed with the powder. A standard laboratory test for this is the time taken for 50.0 grams of metal powder with admixed lubricant to flow through a standard cup. This property is commonly referred to as the flow rate of the mixture and is determined as described by the Metal Powder Industries Federation Standard No.03, Determination of Flow Rate of Free-Flowing Metal Powders Using the Hall Apparatus.

The lubricant allows the compacting pressure to be reduced to attain a specified density before sintering. This is very important because it means that for a given pressure a larger part can be made. Because of the very large pressures required to compact powdered metal, only relatively small parts are made. The density of the compacted (pre-sintered) part is called the green density.

The ejection force to remove the compacted part from the mold is much lower when a lubricant is present and this lower force results in less mold wear.

Unfortunately, the lubricant also has a few adverse effects; some lubricants increase the flow time of the powdered metal and therefore decrease the rate at which a mold can be filled; the lubricant may reduce the strength of the compacted (pre-sintered) part, referred to as the green strength; further, the lubricant can cause an unattractive surface finish on the sintered part. Zinc stearate is commonly used as a lubricant and slowly deposits a thin coating of zinc and zinc oxide on the walls of the furnace used to burn off the lubricant or on the walls of the sintering furnace.

This last disadvantage is often serious, and because of it a wax is sometimes used instead of zinc stearate. The most commonly used wax is ethylenebisstearamide; however, it is not as good a lubricant as zinc stearate, especially with regard to compressibility, i.e., it gives a lower green density for a given compacting pressure. It can only provide the same compressibility as zinc stearate if it is ground to a very fine powder using a special grinding mill which is expensive and consumes a great deal of energy.

U.S. Pat. Nos. 5,368,630 and 5,429,792 describe lubricated metal powder compositions which contain an organic binder. The compositions are designed for high temperature use above 100° C. The organic binder is an essential component to achieve dust-free, segregation free metal powder compositions. The binding agent is introduced in a solvent which is subsequently removed from the powder metal composition. The U.S. Patents teach that not all conventional powder metallurgy lubricants may be employed where compaction is carried out at the high temperature. There is no teaching of the synergistic compositions of this invention.

SUMMARY OF THE INVENTION

It is an object of this invention to provide a novel lubricant composition for powdered metals.

It is a further object of this invention to provide a method of forming a sintered metal part, employing a lubricant composition of the invention.

It is yet another object of this invention to provide a novel composition of matter for the manufacture of a sintered metal article.

In accordance with one aspect of the invention there is provided a synergistic free-flowing lubricant composition for powder metallurgy consisting essentially of boric acid and at least one other powder metallurgy lubricant in admixture.

In accordance with another aspect of the invention there is provided a novel composition of matter for the manufacture of a sintered metal article comprising a sinterable mixture comprising a metal powder and a lubricant, said lubricant being present in an amount of 0.1% to 5%, by weight, said lubricant consisting essentially of a mixture of boric acid and at least one other powder metallurgy lubricant.

In accordance with yet another aspect of the invention there is provided in a method of forming a sintered metal part in which a sinterable powdered metal in admixture with a lubricant is compacted in a mold to form a compacted powdered metal part, the compacted metal part is removed from the mold, the compacted part is heated to decompose and remove the lubricant and sinter the particles of metal with formation of the sintered metal part, the improvement in which the lubricant consists essentially of boric acid in admixture with at least one other powder metallurgy lubricant.

DESCRIPTION OF PREFERRED EMBODIMENTS i) Lubricant

Preferably the lubricant is a synergistic free-flowing mixture containing from 5 to 95%, by weight, of boric acid and from 95 to 5%, by weight, of at least one other powder metallurgy lubricant.

In especially preferred embodiments, the mixture contains from 30 to 70%, more preferably 40 to 60%, by weight, of boric acid and from 70 to 30%, more preferably 60 to 40%, by weight of the at least one other lubricant, to a total of 100%, and most preferably the boric acid and the at least one other lubricant are present in a weight ratio of about 1:1.

In especially preferred embodiments the mixture contains the boric acid and one other powder metallurgy lubricant.

The at least one other powder metallurgy lubricant may be, for example, a metal stearate such as zinc stearate, lithium stearate; or lithium 12-hydroxystearate; an amide wax such as ethylenebisstearamide, as well as other conventional powder metallurgy lubricants such as stearic acid. The indicated lubricants are merely representative of conventional powder metallurgy lubricants which may be employed in admixture with boric acid in accordance with the invention.

The admixture of the boric acid and the at least one other conventional or powder metallurgy lubricant forms a free-flowing particulate composition which provides advantages in powder metallurgy over the conventional powder metallurgy lubricants.

The synergistic free-flowing lubricant mixture is free of organic binders employed in powder metallurgy, which organic binders are sometimes employed to bind the particles of metal powder prior to compaction.

A dry mixture of metal powder, additives such as graphite and copper, and boric acid and the at least one other powder metallurgy lubricant is prepared by adding the additives, boric acid, and the at least one other powder metallurgy lubricant to the metal powder and then blending them together using conventional blenders and mixers.

The additives, boric acid and the at least one other powder metallurgy lubricant can also be added step-wise in any order desired to the metal powder, and then the combined admixture mixed using conventional blenders and mixers.

When mixed with metal powders, the concentration of the lubricant is suitably in the range of 0.1 to 5% by weight, preferably from 0.1 to 1% by weight, and most preferably from 0.2 to 0.8% by weight.

The method can be employed in the manufacture of sintered metal parts from a variety of powdered sinterable metals including ferrous metals, for example iron and steel and non-ferrous metals, for example, aluminum, copper and zinc, as well as mixtures of metal powdered alloys, for example brass powder. It will be understood that such sinterable metal powders may also include conventional additives, for example, graphite or copper which are often employed in admixture with iron, as well as other alloying metals and phosphorus.

The lubricant may also be employed in the manufacture of sintered parts from sinterable metal oxides, and sinterable metal salts, for example, uranium oxide and barium ferrite.

The lubricant or lubricant admixture will generally consist of solid particles, preferably below about 100 microns. Particles that are too large can lead to segregation in the admixture of metal powder and lubricant, or to voids in the sintered parts made from said admixture.

The improved properties of compacted parts made with lubricants consisting essentially of a mixture of boric acid and at least one other powder metallurgy lubricant are the lower flow times, the higher apparent densities, and lower pressures required to eject parts made with said lubricants from the mold.

Preferred lubricants are admixtures of boric acid powder with one or more metal stearates such as, but not limited to, lithium stearate and zinc stearate.

ii) Production of Sintered Metal Article

The lubricant of the invention is advantageously employed in the manufacture of sintered metal articles from powdered metal.

In this method the powdered metal is mixed or blended with the lubricant to form an intimate mixture.

The mixture is compacted in a mold suitably at below about 100° C., and more generally below 95° C., at a pressure effective to form the mixture into a self-supporting shaped body. The compacting pressure depends on the particular metal powder and may be from 1 t.s.i. to 100 t.s.i.; generally compacting pressures of 10 t.s.i. to 75 t.s.i. are satisfactory.

During compaction of powder and ejection of parts from a die, where neither the powder nor the die are being heated externally, the parts heat up due to friction between metal particles and between the part and the die walls. After several parts have been produced, the die also may be warmer than ambient temperature because of these frictional effects. The temperature of a green compact can range from 80° F. (27° C.) to 200° F. (93° C.), with 145° F. (63° C.) being typical.

The self-supporting body is removed from the mold and is heated to decompose and remove the lubricant and to sinter the metal particles. This heating operation may take place in two separate stages, most of the lubricant being removed in a first heating stage and any residual material subsequently being removed in the sintering furnace. The lubricant could be removed entirely in the sintering furnace but this results in deposits on the interior of the sintering furnace which may serve to decrease the efficiency of the furnace over a period of time.

Thus in a particular embodiment the compacted part is ejected from the mold and is heated to a first elevated temperature effective to decompose and remove the lubricant, and then to a second elevated temperature effective for sintering of the particles of metal, the second temperature being higher than the first temperature.

The ejection load, green density, and green strength in the following Examples were determined for compacted bars measuring about 1.25 inches long, about 0.5 inch wide, and about 0.25 inch high. Green strengths and sintered strengths were measured for these bars using a Hounsfield Tensometer under conditions of 3-point loading with a span of 1 inch. Springback is expressed as a percentage from die size, i.e. green bar length minus 1.25 inches, divided by 1.25 inches, multiplied by 100. Dimensional change is expressed as a percentage of green bar length, i.e. green bar length minus sintered bar length, divided by green bar length, multiplied by 100.

EXAMPLE 1

The properties of mixtures of ATOMET® (trade-mark of Quebec Metal Powders Limited) 1001 high compressibility water-atomized steel powder containing about 0.40% Lubricant A (a mixture of 55% by weight lithium stearate with 45% by weight ethylenebisstearamide wax) by weight of ATOMET® 1001 powder are given in Table I. Powder properties (Flow Rate (sec/50 g), Apparent Density (g/cc), Green Properties (Ejection load, Springback, Density, Strength) and Sintered Properties (Density, Strength, Dimensional Change) are reported. The composition Lubricant A/Boric Acid was prepared by intimately mixing Lubricant A and boric acid together at a ratio of one to one by weight.

TABLE I

| Lubricant | Powder Flow Rate, sec/50 g | Powder App. Dens., g/cm$^3$ | Green Ejection. lb |
|---|---|---|---|
| Lubricant A | 25.9 | 3.30 | 6580 |
| Lubricant A/ Boric Acid | 25.6 | 3.26 | 5108 |

| Lubricant | Green Springback, % | Green Dens., g/cm$^3$ | Green Strength, psi |
|---|---|---|---|
| Lubricant A | 0.11 | 6.86 | 1524 |
| Lubricant A/ Boric Acid | 0.12 | 6.87 | 1354 |

| Lubricant | Sintered Dens., g/cm$^3$ | Sintered Strength, psi | Sintered Dim. Change, % |
|---|---|---|---|
| Lubricant A | 6.85 | 58242 | −0.12 |
| Lubricant A/ Boric Acid | 6.86 | 66278 | −0.07 |

EXAMPLE 2

The properties of mixtures of ATOMET® 1001 metal powder containing about 0.75% lubricant by weight of ATOMET® 1001 powder are given in Table II. Powder properties (Flow Rate (sec/50 g), Apparent Density (g/cc), Green Properties (Ejection load, Springback, Density, Strength) and Sintered Properties (Density, Strength, Dimensional Change) are reported. The composition Lubricant A/Boric Acid was prepared by intimately mixing Lubricant A (defined in Example 1) and boric acid together at a ratio of one to one by weight. Table II demonstrates that using an about one to one by weight ratio of boric acid with Lubricant A gives an ejection load which is much lower than that expected on the basis of the ejection loads of compositions comprised of just boric acid as lubricant or of just Lubricant A as lubricant.

TABLE II

| Lubricant | Powder Flow Rate, sec/50 g | Powder App. Dens., g/cm$^3$ | Green Ejection, lb |
|---|---|---|---|
| Lubricant A | 26.3 | 3.33 | 4884 |
| Boric Acid | 38.7 | 3.08 | 8980 |
| Lubricant A/ Boric Acid | 26.2 | 3.26 | 3176 |

| Lubricant | Green Springback, % | Green Dens., g/cm$^3$ | Green Strength, psi |
|---|---|---|---|
| Lubricant A | 0.12 | 6.92 | 1517 |
| Boric Acid | 0.16 | 6.66 | 1811 |
| Lubricant A/ Boric Acid | 0.15 | 6.88 | 1288 |

| Lubricant | Sintered Dens., g/cm$^3$ | Sintered Strength, psi | Sintered Dim. Change, % |
|---|---|---|---|
| Lubricant A | 6.91 | 54746 | −0.14 |
| Boric Acid | — | — | — |
| Lubricant A/ Boric Acid | 6.89 | 63963 | −0.13 |

EXAMPLE 3

The properties of mixtures of ATOMET® 1001 metal powder containing about 2.06% copper by weight of ATOMET® 1001 powder, about 0.62% graphite by weight of ATOMET® 1001 powder, and 0.41% lubricant by weight of ATOMET® 1001 powder are given in Table III. Powder properties (Flow Rate (sec/50 g), Apparent Density (g/cc), Green Properties (Ejection load, Springback, Density, Strength) and Sintered Properties (Density, Strength, Dimensional change) are reported. The composition Lubricant A/boric acid was prepared by intimately mixing Lubricant A (defined in Example 1) and boric acid together at a ratio of one to one by weight.

TABLE III

| Lubricant | Powder Flow Rate, sec/50 g | Powder App. Dens., g/cm$^3$ | Green Ejection, lb |
|---|---|---|---|
| Lubricant A | 29.4 | 3.25 | 3972 |
| Lubricant A/ Boric Acid | 26.9 | 3.34 | 2460 |

| Lubricant | Green Springback, % | Green Dens., g/cm$^3$ | Green Strength, psi |
|---|---|---|---|
| Lubricant A | 0.11 | 6.81 | 1236 |
| Lubricant A/ Boric Acid | 0.13 | 6.81 | 1165 |

| Lubricant | Sintered Dens., g/cm$^3$ | Sintered Strength, psi | Sintered Dim. Change, % |
|---|---|---|---|
| Lubricant A | 6.71 | 114400 | 0.27 |
| Lubricant A/ Boric Acid | 6.73 | 110743 | 0.24 |

EXAMPLE 4

The properties of mixtures of ATOMET® 1001 metal powder containing about 2.07% copper by weight of ATOMET® 1001 powder, about 0.62% graphite by weight of ATOMET® 1001 powder, and 0.78% lubricant by weight of ATOMET® 1001 powder are given in Table IV. Powder properties (Flow Rate (sec/50 g), Apparent Density (g/cc), Green Properties (Ejection load, Springback, Density, Strength) and Sintered Properties (Density, Strength, Dimensional Change) are reported. The composition Lubricant A/boric acid was prepared by intimately mixing Lubricant A (defined in Example 1) and boric acid together at a ratio of one to one by weight.

TABLE IV

| Lubricant | Powder Flow Rate, sec/50 g | Powder App. Dens., g/cm$^3$ | Green Ejection, lb |
|---|---|---|---|
| Lubricant A | 32.7 | 3.25 | 3524 |
| Lubricant A/ Boric Acid | 29.5 | 3.24 | 1816 |

| Lubricant | Green Springback, % | Green Dens., g/cm$^3$ | Green Strength, psi |
|---|---|---|---|
| Lubricant A | 0.14 | 6.81 | 1185 |
| Lubricant A/ Boric Acid | 0.16 | 6.80 | 1106 |

| Lubricant | Sintered Dens., g/cm$^3$ | Sintered Strength, psi | Sintered Dim. Change, % |
|---|---|---|---|
| Lubricant A | 6.69 | 99248 | 0.34 |
| Lubricant A/ Boric Acid | 6.72 | 102575 | 0.17 |

EXAMPLE 5

Boric acid can be advantageously used in admixture with various other conventional lubricants, such as those listed in Table V, but not restricted to those listed, wherein Lubricant B refers to a mixture of 25% by weight zinc stearate with 75% by weight ethylenebisstearamide wax. The properties of mixtures containing lubricant at about 0.75% by weight of ATOMET® 1001 powder are given in Table V. Powder properties (Flow Rate (sec/50 g), Apparent Density (g/cc), and Green Properties (Ejection load, Springback, Density, Strength). The lubricants containing boric acid were prepared by intimately mixing the components together at a ratio of one to one by weight. Much lower ejection forces were required to eject the transverse rupture bars using any of the listed lubricants containing boric acid than if a single lubricant was used alone, without admixed boric acid.

TABLE V

| Lubricant | Powder Property Flow Rate, sec/50 g | Powder Property App. Density, g/cm$^3$ | Green Property Ej. Force, lbs | Green Property Density, g/cm$^3$ | Green Property Strength, psi | Green Property Springback, % |
|---|---|---|---|---|---|---|
| Zinc stearate | 25.2 | 3.29 | 5676 | 6.87 | 1359 | 0.13 |
| Zinc stearate/boric acid | 23.2 | 3.29 | 2504 | 6.91 | 1506 | 0.15 |
| Lithium stearate | 24.7 | 3.36 | 5456 | 6.92 | 1351 | 0.14 |
| Lithium stearate/boric acid | 23.4 | 3.35 | 2040 | 6.92 | 1473 | 0.14 |
| Lubricant B | 26.4 | 3.27 | 5752 | 6.91 | 1520 | 0.12 |
| Lubricant B/boric acid | 26.7 | 3.16 | 2592 | 6.92 | 1635 | 0.06 |

EXAMPLE 6

Additional mixture formulations are listed in Table VI. The properties of mixtures containing about 0.75% lubricant by weight of Kobelco 300 MA high compressibility water-atomized steel powder are given in Table VII. Powder properties (Flow Rate (sec/50 g), Apparent Density (g/cc), and Green Properties (Ejection load, Springback, Density, Strength) are reported. The lubricants containing boric acid were prepared by intimately mixing the components together. Again, much lower ejection forces were required to eject the transverse rupture bars using any of the listed lubricants containing boric acid than if the lubricant was used alone, without admixed boric acid.

TABLE VI

| Sample No. (for use with Table VII) | % by Weight in Lubricant Admixture | | | | |
|---|---|---|---|---|---|
| | Zinc Stearate (Supplier A) | Zinc Stearate (Supplier B) | Lithium Stearate | Ethylene-bisstearamide Wax | Boric Acid |
| 1 | 100 | — | — | — | — |
| 2 | 75 | — | — | — | 25 |
| 3 | 50 | — | — | — | 50 |
| 4 | 25 | — | — | — | 75 |
| 5 | — | — | — | — | 100 |
| 6 | — | — | 100 | — | — |
| 7 | — | — | 75 | — | 25 |
| 8 | — | — | 50 | — | 50 |
| 9 | — | — | 25 | — | 75 |
| 10 | — | 25 | — | 75 | — |
| 11 | — | 18.75 | — | 75 | 6.25 |
| 12 | — | 12.50 | — | 75 | 12.50 |
| 13 | — | 6.25 | — | 75 | 18.75 |
| 14 | — | — | — | 75 | 25 |

TABLE VII

| Composition | Powder Properties | | Green Properties | | | |
|---|---|---|---|---|---|---|
| Number (from Table VI) | Flow Rate, sec. | App. Dens., g/cm$^3$ | Density, g/cm$^3$ | Ej. Force, lbs | Strength, psi | Spring-back, % |
| Kobelco 300 MA | 24.9 | — | — | — | — | — |
| 1 | 26.1 | 3.25 | 6.84 | 4790 | 1142 | 0.14 |
| 2 | 25.9 | 3.21 | — | — | — | — |

TABLE VII-continued

| Composition | Powder Properties | | Green Properties | | | |
|---|---|---|---|---|---|---|
| Number (from Table VI) | Flow Rate, sec. | App. Dens., g/cm$^3$ | Density, g/cm$^3$ | Ej. Force, lbs | Strength, psi | Spring-back, % |
| 3 | 24.3 | 3.26 | — | — | — | — |
| 4 | 25.6 | 3.24 | 6.82 | 1713 | 1264 | 0.19 |
| 5 | 30.6 | 3.35 | — | — | — | — |
| 6 | 28.2 | 3.29 | 6.91 | 4247 | 1153 | 0.14 |
| 7 | 26.2 | 3.29 | — | — | — | — |
| 8 | 25.5 | 3.29 | — | — | — | — |
| 9 | 26.5 | 3.30 | 6.81 | 1683 | 1121 | 0.18 |
| 10 | 29.5 | 3.19 | — | — | — | — |
| 11 | 29.4 | 3.16 | — | — | — | — |
| 12 | 29.9 | 3.12 | — | — | — | — |
| 13 | 31.6 | 3.03 | — | — | — | — |
| 14 | 34.0 | 2.99 | — | — | — | — |

We claim:

1. A novel composition of matter for the manufacture of a sintered metal article comprising a sinterable mixture consisting essentially of a metal powder and a lubricant, said lubricant being present in an amount of 0.1% to 5%, by weight, said lubricant comprising a mixture of boric acid and at least one other powder metallurgy lubricant, said boric acid in said mixture providing improved processing characteristics in said manufacture.

2. A composition according to claim 1 wherein said metal powder is an iron-based powder.

3. A composition according to claim 2, wherein said iron-based metal powder contains graphite as an additive.

4. A composition according to claim 2, wherein said iron-based metal powder contains copper as an additive.

5. A composition according to claim 1 wherein said mixture contains from 5 to 95%, by weight, of boric acid and from 95 to 5%, by weight, of said at least one other powder metallurgy lubricant.

6. A composition according to claim 5, wherein said at least one other lubricant is selected from zinc stearate, lithium stearate, lithium 12-hydroxy stearate, ethylene-bisstearamide, or stearic acid.

7. A composition according to claim 5 wherein said lubricant comprises said boric acid and said at least one other lubricant in a weight ratio of about 1:1.

8. A synergistic free-flowing lubricant composition for powder metallurgy consisting essentially of boric acid and at least one other powder metallurgy lubricant in admixture, said boric acid in said admixture providing improved processing characteristics in said manufacture.

9. A synergistic composition according to claim 8, wherein the mixture contains from 5 to 95%, by weight, of boric acid and from 95 to 5%, by weight, of said at least one powder metallurgy lubricant.

10. A synergistic composition according to claim 9, wherein said at least one other powder metallurgy lubricant is selected from zinc stearate, lithium stearate, lithium 12-hydroxystearate, ethylene-bisstearamide, or stearic acid.

11. A synergistic composition according to claim 10, wherein said mixture comprises said boric acid and said at least one other lubricant in a weight ratio of about 1:1.

12. A method of forming a sintered metal part comprising:

compacting a sinterable powdered metal in admixture with a lubricant in a mold to form a compacted powdered metal part, removing the compacted part from the mold, heating the compacted part to decompose and remove the lubricant and sinter the particles of metal with formation of the sintered metal part, said lubricant consisting essentially of a mixture of boric acid and at least one other powder metallurgy lubricant.

13. A method according to claim 12 wherein said mixture contains from 5 to 95%, by weight, of said boric acid and from 95 to 5%, by weight, of said at least one other metallurgy lubricant and said mixture comprises 0.1% to 5%, by weight, of said compacted powdered metal part.

14. A method according to claim 13 wherein said at least one other lubricant is selected from zinc stearate, lithium stearate, lithium 12-hydroxy stearate, ethylene-bisstearamide, or stearic acid.

15. A method according to claim 13, wherein said compacting is at a temperature below 95° C.

16. A method according to claim 15, wherein said step of removing comprises ejecting the compacted part from the mold at an ejection pressure lower than that of a corresponding method of forming a sintered metal part from a said sinterable powdered metal and lubricant, in which said powdered metal and lubricant are free of boric acid.

17. A method according to claim 16, wherein said step of heating the compacted part comprises a first heating stage in which the compacted part is heated to decompose at least a major part of the lubricant and a second heating stage in which the particles of metal are sintered to form said sintered metal part with decomposition of any residual lubricant.

18. A method according to claim 16, wherein said at least one other powder metallurgy lubricant comprises a metal stearate and ethylene bisstearamide.

19. A method according to claim 18, wherein said metal stearate is lithium stearate or zinc stearate.

20. A method according to claim 19, wherein said compacted powdered metal part is free of graphite.

21. A composition according to claim 2, wherein said sinterable mixture is free of graphite.

22. A composition according to claim 4, wherein said sinterable mixture is free of graphite.

* * * * *

UNITED STATES PATENT AND TRADEMARK OFFICE

CERTIFICATE OF CORRECTION

PATENT NO. : 6,001,150
DATED : December 14, 1999
INVENTOR(S) : James M. McCall et al It is certified that error appears in the above-identified patent and that said Letters Patent is hereby corrected as shown below:

Item [54] on the title page bibliography, at line 2, "POWERED" should read --- POWDERED ---, at both occurrences.

Column 1,
Line 2, of the title "POWERED" should read --- POWDERED ---, at both occurrences.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*